US005414892A

United States Patent [19]

Clark, Jr.

[11] Patent Number: 5,414,892

[45] Date of Patent: May 16, 1995

[54] MOP BUCKET COVER HAVING WRINGER AND STORAGE DEVICE

[75] Inventor: Franklin T. Clark, Jr., Girard, Pa.

[73] Assignee: Emsco, Inc., Girard, Pa.

[21] Appl. No.: 182,291

[22] Filed: Jan. 14, 1994

Related U.S. Application Data

[63] Continuation of Ser. No. 921,323, Jul. 29, 1992, abandoned.

[51] Int. Cl.[6] ..... A47L 13/58

[52] U.S. Cl. ..... 15/263; 15/264

[58] Field of Search ..... 15/264, 260, 262, 263, 15/261; 220/735, 736, 697, 694

[56] References Cited

U.S. PATENT DOCUMENTS

| | | | |
|---|---|---|---|
| 609,710 | 8/1898 | Sprague | 15/263 |
| 1,722,130 | 7/1929 | Finstad | 15/263 |
| 1,725,213 | 8/1929 | Schulman | 15/263 |
| 1,882,918 | 10/1932 | Robb | 15/263 |
| 1,935,157 | 11/1933 | Lisanti | 15/263 |
| 1,952,824 | 3/1934 | Schulman | 15/263 |
| 2,079,186 | 5/1937 | Schulman | 15/263 |
| 2,143,846 | 1/1939 | Griddings | 15/263 |
| 3,383,732 | 5/1968 | James et al. | 15/260 |
| 4,203,537 | 5/1980 | McAlister | 220/697 |
| 4,525,892 | 7/1985 | Vayas et al. | 15/263 |
| 4,583,666 | 4/1986 | Buck | 15/264 |
| 4,735,332 | 4/1988 | Thumser | 15/263 |
| 4,888,847 | 12/1989 | Montijo | 15/263 |
| 4,947,998 | 8/1990 | Smeller | 220/694 |
| 5,063,631 | 11/1991 | Parker | 15/263 |
| 5,123,576 | 6/1992 | Lawrence | 220/697 |

FOREIGN PATENT DOCUMENTS

| | | | |
|---|---|---|---|
| 15552 | 9/1929 | Australia | 15/263 |
| 480581 | 1/1952 | Canada | 15/263 |
| 1426827 | 12/1965 | France | 15/260 |
| 1542790 | 9/1968 | France | 15/263 |
| 2401645 | 4/1979 | France | 15/260 |
| 2726 | of 1894 | United Kingdom | 15/263 |
| 411330 | 6/1934 | United Kingdom | 15/263 |
| 603403 | 6/1948 | United Kingdom | 15/263 |
| 2189384 | 10/1987 | United Kingdom | 15/260 |

*Primary Examiner*—David A. Scherbel
*Assistant Examiner*—Tony G. Soohoo
*Attorney, Agent, or Firm*—Lovercheck and Lovercheck

[57] ABSTRACT

A mop bucket and a cover for the mop bucket. The cover has a mop receptacle and a splash guard integrally molded together using thermosetting plastic. The cover has a unique mop receptacle that facilitates a liquid to be wrung from a mop. The receptacle has a mop receiving hole in the bottom to receive a stored mop handle. The splash guard guides the mop yarns from the bucket into the receptacle and prevents liquid from splashing out of the bucket when the bucket is moved over uneven floors. The cover and bucket are balanced about the handle for carrying.

12 Claims, 3 Drawing Sheets

MOP BUCKET COVER HAVING WRINGER AND STORAGE DEVICE

This is a continuation of application(s) Ser. No. 07/921,323, filed on Jul. 29, 1992, now abandoned.

BACKGROUND OF THE INVENTION

The present invention relates to mop buckets and more particularly to covers for mop buckets with mop wringers and mop supports.

Applicant is aware of the following U.S. Patents:

| | |
|---|---|
| D292,238 to O'Brien | 4,525,892 to Vayas et al. |
| 1,405,201 to Gates | 4,713,859 to Smith, Jr. |
| 1,952,824 to Schulman | 4,716,619 to Young |
| 2,567,708 to Heber | 4,735,332 to Thumser |
| 2,577,496 to Wolfer | 4,888,847 to Montjo |
| 3,747,154 to O'Neil | |
| 2,143,846 to Gaddings | 4,583,666 to Buck |
| 3,383,732 to James etal | 5,063,631 to Parker |

The above references do not show a mop bucket cover with a generally cylindrical mop receptacle attached to a top plate with side walls spaced from the mop receptacle. The sides having support means to engage the bucket to hold the top plate a substantial distance above the top of the bucket. Nor do the references show such a mop bucket cover that has sides with triangular extensions which extend from the sides and have a pouring lip attached to the side walls, and a transverse wall.

The Vayas Patent shows a mop bucket cover with top plate that is substantially flush with the top of the bucket; Montijo shows a bucket cover with a fresh water tank supported on the bucket and no triangular sides or pouring lip; Buck shows a paint brush holder in the form of a ring that rests on a paint can with a brush holder supported on the ring. The other Patents show structures similar to the above.

SUMMARY OF THE INVENTION

The mop bucket cover of the present invention provides a mop receptacle with improved control for wringing out specific amounts of liquid from a mop. A splash guard is provided which prevents liquid from splashing out of the bucket while moving the bucket over a rough floor. The splash guard or drip guard reduces splash as the mop yarns are being moved from the wide mouth cover opening to the mop receptacle. The cover is balanced for carrying. The bucket itself is equipped with bucket supported casters which add stability to the bucket.

The receptacle allows the user to twist the mop, thus eliminating stooping and bending and the cover can be used with a variety of commonly used mops. The hole in the receptacle bottom provides for storage and drying of the mop.

It is an object of the present invention to provide an improved mop bucket and cover. Another object is to provide a mop bucket and cover that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENT(S)

Figure 1:
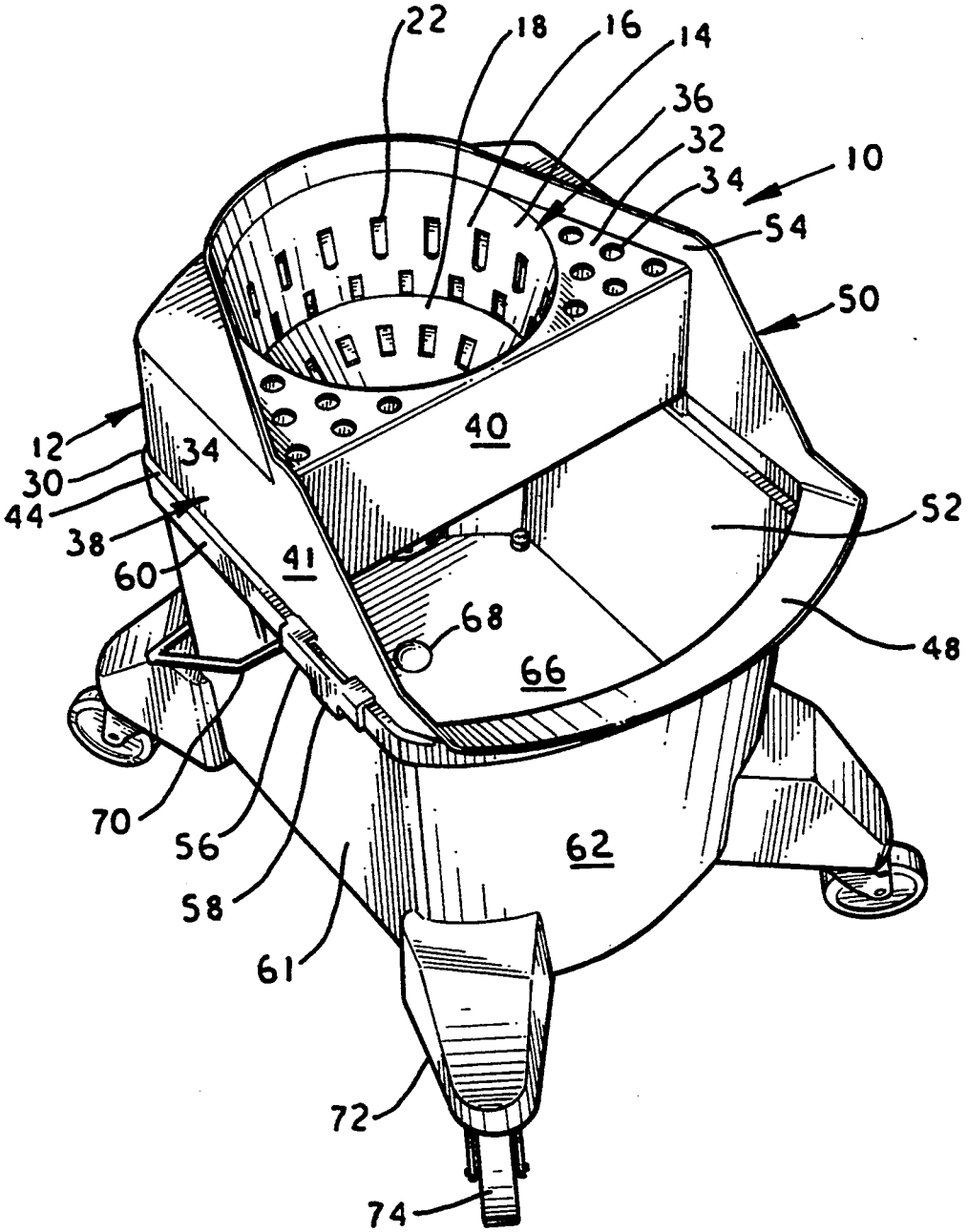
FIG. 1 is an isometric view of a mop bucket and cover according to the invention.
Figure 2:
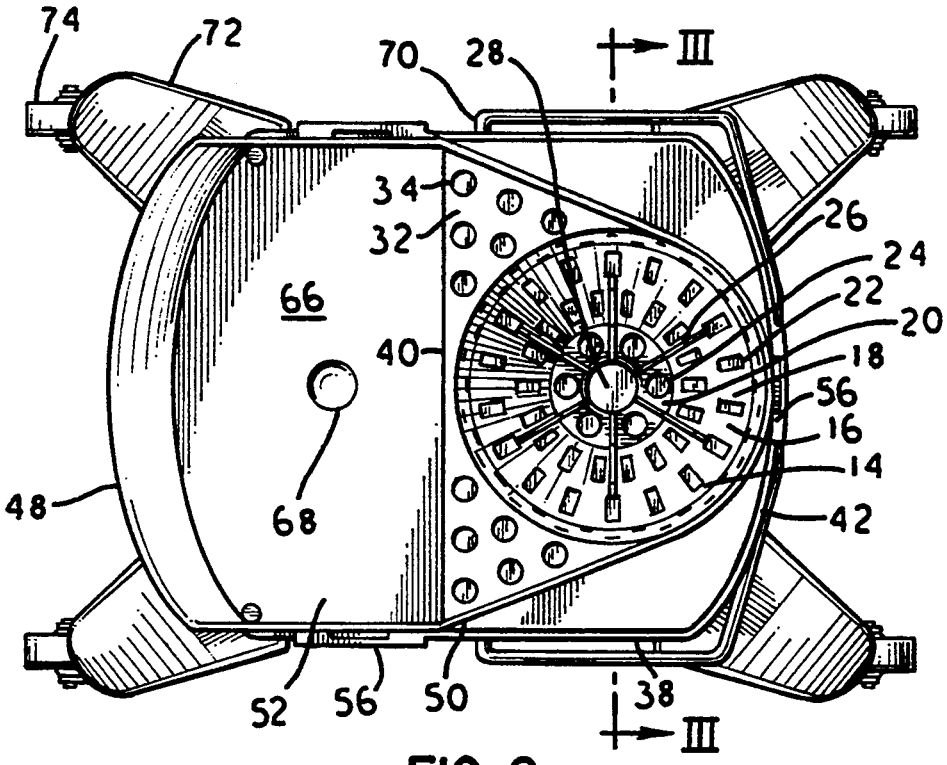
FIG. 2 is a top view of the mop bucket and cover according to the invention.
Figure 3:
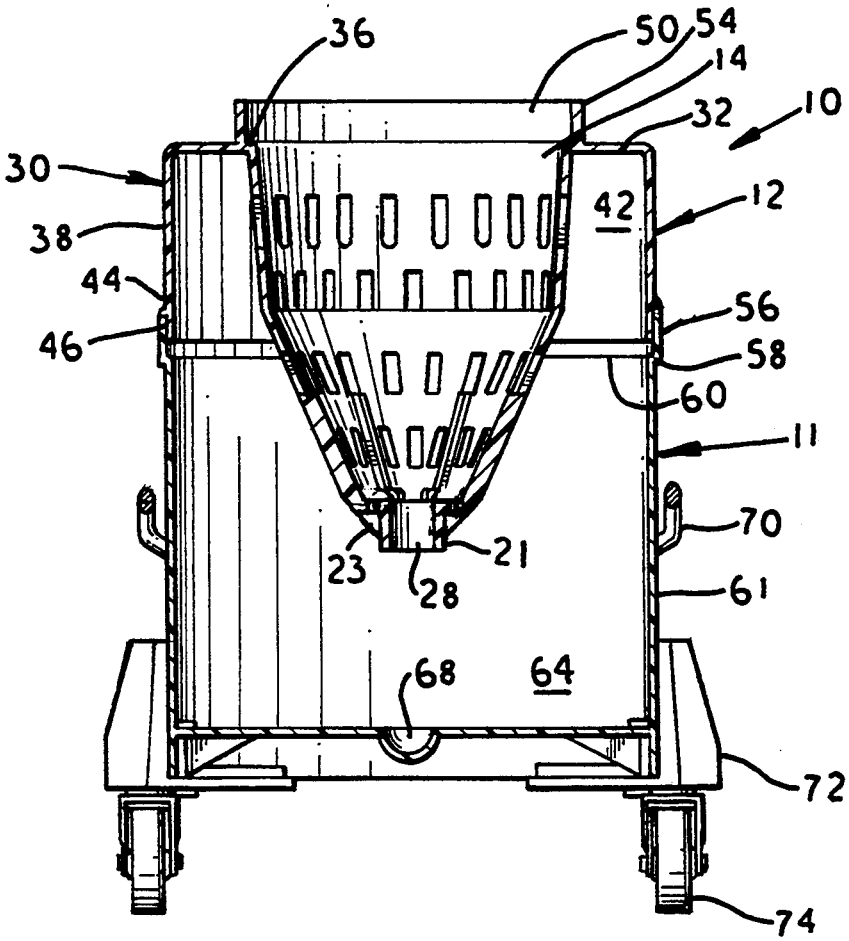
FIG. 3 is a cross sectional view taken on line 3—3 of FIG. 2.

Now with more particular reference to the drawings, shown is a combination 10 of a mop bucket and a cover. Cover 12 has a wringer system which includes mop receptacle 14. Mop receptacle 14 has generally cylindrical upper wall 16 with a circular upper end having its lower end integrally attached to generally frustoconical lower wall 18. Frustoconical lower wall 18 has receptacle bottom 20 which forms the lower end of mop receptacle 14.

Axially and circumferentially spaced rectangular elongated holes 22 are formed in upper wall 16 and in lower wall 18 of mop receptacle 14. Round holes 24 are formed in receptacle bottom 20. Circumferentially spaced, axially and inwardly extending ribs 26 are integrally attached to the inside of lower wall 18 of receptacle 14 to more thoroughly and evenly remove water or other liquids from a mop. Central handle receiving opening 28 and tubular spout 21 are formed in and integrally attached to the under side of receptacle bottom 20. Gussets 23 are attached to receptacle bottom 20 and to spout 21.

Receptacle support means 30 is comprised of top plate 32 having spaced holes 34 and circular central opening 36, outer side walls 38, transverse wall 40 and end wall 42. Central opening 36 receives the circular upper end of upper wall 16 of mop receptacle 14.

Outer side walls 38 have generally rectangular rear part 39 and spaced legs attached to said rectangular part terminating in triangular front part 41. Upper wall 16 and outer side walls 38 are integrally attached to top plate 32. Transverse wall 40 is spaced from end wall 42 and is integrally attached to top plate 32. The outer ends of transverse wall 40 are integrally attached to outer side walls 38. The lower edges of outer sides walls 38 terminate at about the same level as the lower end of the cylindrical upper wall up to mop receptacle and have bead 44 integrally attached to and spaced upwardly from the lower edges of side walls 38 and rests on the upper edge of mop bucket 11. Outer side walls 38 and end wall 42 have an extension 46 which is adapted to extend downward into mop bucket 11 to hold cover 12 in place. Outer side walls extend forward from transverse wall 40 to the front of cover 12 and are integrally attached to upwardly and outwardly sloping pouring lip 48.

Splash guard 50 has flange 54 having a generally U-shaped intermediate part supported on top plate 32 which is fixed to an upper end of upper wall 16. Splash guard forms a continuation of an inner surface of upper wall Flange 54 then extends outwardly to the ends of transverse wall 40 and continues downwardly and forwardly from transverse wall 40 to the outer ends of pouring lip 48.

Cover opening 52 in cover 12 is surrounded by triangular front part 41 of side walls 38, transverse wall 40 and pouring lip 48.

Mop bucket 11 has peripheral flange 60, side walls 61, front wall 62, rear wall 64, bottom 66 with recess 68 to receive the end of a mop handle that may be extended through handle receiving opening 28 in receptacle bottom 20. Handle 70 is swingably attached to mop bucket 11 at the central part of side walls 61. Mop bucket 11 has caster support brackets 72 and caster wheels 74 which enables mop bucket to be conveniently moved around on a floor.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A mop bucket cover comprising receptacle and a receptacle support;

said receptacle support comprising a top plate, outer side walls, an end wall and a transverse wall;

said outer side walls, said end wall and said transverse wall being integrally attached to said top plate and extending downwardly therefrom;

said receptacle having a substantially cylindrical upper wall and a generally frustoconical lower wall;

said upper wall having rows of circumferentially spaced holes to provide for water to return to said receptacle;

said top plate having a central opening receiving said receptacle; and, support means attached to said outer side walls for supporting said receptacle on a mop bucket;

said transverse wall fixed to said top plate and to said side walls and extending down from said top plate;

said top plate providing a baffle for water in said bucket;

an upwardly extending splash guard attached to said top plate extends around said central opening and in a forward and outward direction towards said transverse wall;

said outer side walls each comprise a rectangular rear part extending forwardly to said transverse wall and a triangular front part extending forwardly from said transverse wall and having an upwardly and forwardly extending pouring lip between said front part of said transverse wall;

and a cover opening defined between said transverse wall, said triangular front part of said side walls, and said pouring lip adapted to receive liquid from said mop bucket.

2. The mop bucket cover recited in claim 1 wherein said receptacle bottom has a centrally disposed mop handle receiving opening therein for receiving a mop handle and for storing a mop therein.

3. The mop bucket cover recited in claim 1 wherein said cover is supported on said mop bucket;

said receptacle bottom having a central opening for receiving a mop handle;

said mop bucket having a bottom with a central recess therein;

said recess being adapted to receive an end of a mop handle.

4. The mop bucket recited in claim 1 wherein said splash guard means comprises a flange fixed to said top plate adjacent said central opening of said mop receptacle and extending along said top plate to said receptacle support means adjacent said transverse wall.

5. In combination, a mop bucket and a cover;

said cover having a mop receptacle for receiving and wringing a mop;

said mop receptacle having a frustoconical wall having a lower end and a receptacle bottom closing said lower end of said mop receptacle;

said receptacle bottom having spaced holes therethrough to return water from said receptacle to said bucket and said receptacle bottom being integrally attached to said lower end;

a top plate having a central opening receiving said mop receptacle;

side walls integrally attached to said top plate and extending downwardly therefrom;

a pouring lip attached to said side walls and spaced from said mop receptacle defining a cover opening between said pouring lip and said mop receptacle for filling said mop bucket.

6. The combination recited in claim 5 wherein said receptacle bottom has a centrally disposed handle receiving opening therein for receiving a mop handle and for storing a mop therein.

7. The combination recited in claim 6 wherein said frustoconical wall has circumferentially spaced inwardly and upwardly extending ribs thereon for removing liquid from mops.

8. The combination recited in claim 7 wherein a transverse wall is disposed between said receptacle and said cover opening.

9. The combination recited in claim 5 wherein a splash guard is attached to said top plate and extends upwardly therefrom adjacent said central opening;

said splash guard extending forwardly from said central opening and extending adjacent said cover opening to said pouring lip.

10. The combination recited in claim 5 wherein said support means comprises outer side walls;

a transverse wall integrally attached to said outer side walls;

said outer side walls having a bead attached thereto;

said support means being adapted to rest on an upper edge of said mop bucket.

11. The combination recited in claim 10 wherein an end wall is connected to said outer side walls and said end wall have an extension adapted to extend downwardly into said mop bucket.

12. The combination recited in claim 11 wherein said outer side walls and said end wall each have a lug thereon;

said lug being adapted to rest on said mop bucket;

said lug having a hook extending downwardly therefrom and underlying a flange on said mop bucket thereby holding said cover in place.

* * * * *